US009574381B2

(12) United States Patent
Beck et al.

(10) Patent No.: US 9,574,381 B2
(45) Date of Patent: Feb. 21, 2017

(54) DOOR HANDLE ASSEMBLY FOR A MOTOR VEHICLE

(71) Applicants: Andreas Beck, Bochum (DE); Dirk Muller, Essen (DE); Christian Bresser, Leichlingen (DE)

(72) Inventors: Andreas Beck, Bochum (DE); Dirk Muller, Essen (DE); Christian Bresser, Leichlingen (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 94 days.

(21) Appl. No.: 14/303,367

(22) Filed: Jun. 12, 2014

(65) Prior Publication Data

US 2014/0367977 A1 Dec. 18, 2014

(30) Foreign Application Priority Data

Jun. 13, 2013 (DE) ..... 10 2013 106 176

(51) Int. Cl.
*E05B 3/00* (2006.01)
*E05B 85/14* (2014.01)
(Continued)

(52) U.S. Cl.
CPC ..... *E05B 85/14* (2013.01); *E05B 77/06* (2013.01); *E05B 85/10* (2013.01); *E05B 79/20* (2013.01); *Y10T 292/57* (2015.04)

(58) Field of Classification Search
CPC ..... E05B 85/14; E05B 77/02; E05B 77/04; E05B 77/06; E05B 1/003; E05B 1/0038; E05B 1/0046; E05B 1/0053; E05B 1/0084; E05B 1/0092; E05B 1/06; E05B 2001/0076; E05B 3/00; E05B 5/00; E05B 5/003;E05B 5/006; E05B 7/00; E05B 81/64; E05B 81/76; E05B 81/77; E05B 81/78; E05B 79/20; E05B 85/10; Y10T 292/57
(Continued)

(56) References Cited

U.S. PATENT DOCUMENTS 3,967,844 A * 7/1976 Torii ..... E05B 85/18 292/210
3,993,338 A * 11/1976 Cherbourg ..... B60J 5/06 292/336.3
(Continued)

FOREIGN PATENT DOCUMENTS

DE 19929022 1/2001
DE 101 14 966 A1 10/2002
(Continued)

OTHER PUBLICATIONS

European Search Report of related EP Application No. 14170322 dated Aug. 14, 2015, 6 pages.

*Primary Examiner* — Kristina Fulton
*Assistant Examiner* — Faria Ahmad
(74) *Attorney, Agent, or Firm* — Fay Sharpe LLP

(57) ABSTRACT

A door handle assembly for a motor vehicle includes an operating handle, a mechanical coupling device, and a locking device attached to a handle mounting. An acceleration force can block an actuation of the closing assembly via the operating handle and/or the coupling device so that an unintended unlatching of the door closure during a vehicle accident is prevented. The locking device has a locking element, which is movably coupled to the mechanical coupling device by a connecting element, such that, a pivotal movement of the mechanical coupling device will rotate the locking element about a rotational axis. The locking element includes at least one locking member which is designed to
(Continued)

block the rotational movement of the locking element when a predetermined displacement speed of the operating handle has been exceeded.

9 Claims, 6 Drawing Sheets

(51) Int. Cl.
*E05B 77/06* (2014.01)
*E05B 85/10* (2014.01)
*E05B 79/20* (2014.01)

(58) Field of Classification Search
USPC ..... 292/336.3, DIG. 22
See application file for complete search history.

(56) References Cited

U.S. PATENT DOCUMENTS 3,993,339 A * 11/1976 Cherbourg ..... E05B 5/00 292/336.3
4,486,041 A * 12/1984 Takasaki ..... E05C 3/162 292/221
4,487,441 A * 12/1984 Miyamoto ..... E05B 77/265 292/216
4,732,417 A * 3/1988 Yang ..... E05C 1/14 292/142
5,039,145 A * 8/1991 Frye ..... E05B 85/12 292/143
5,092,642 A * 3/1992 Lindmayer ..... E05B 77/42 292/201
5,497,640 A * 3/1996 Kokuryo ..... E05B 81/04 292/336.3
5,860,684 A * 1/1999 Mizuki ..... E05B 83/36 292/336.3
6,598,912 B2 * 7/2003 Hillgaertner ..... E05B 13/005 292/225
6,648,382 B1 * 11/2003 Monig ..... E05B 77/06 292/336.3
7,686,355 B2 * 3/2010 Jankowski ..... E05B 77/06 292/216
8,366,159 B2 * 2/2013 Patel ..... E05B 77/06 292/203
8,408,612 B2 * 4/2013 Jankowski ..... E05B 77/06 292/216
8,424,936 B2 * 4/2013 Muller ..... E05B 85/16 292/336.3
2009/0044378 A1 * 2/2009 Jankowski ..... E05B 77/06 16/412
2010/0237633 A1 * 9/2010 Jankowski ..... E05B 77/06 292/216
2011/0120022 A1 * 5/2011 Papanikolaou ..... E05B 77/06 49/460
2014/0292005 A1 * 10/2014 Bendel ..... E05B 77/06 292/336.3
2014/0312633 A1 * 10/2014 Ilardo ..... E05B 77/06 292/336.3
2014/0361556 A1 * 12/2014 Beck ..... E05B 77/06 292/336.3

FOREIGN PATENT DOCUMENTS

DE 102009053553 5/2011
DE 10 2011 100 090 A1 10/2012
EP 1 010 846 A1 6/2000
EP 1 518 983 A2 3/2005

* cited by examiner

DOOR HANDLE ASSEMBLY FOR A MOTOR VEHICLE

BACKGROUND

The invention addresses a door handle assembly for a motor vehicle, having a frame-like handle mounting, an operating handle that is movably supported on the handle mounting for the opening of a door or hatch of the motor vehicle by user, a mechanical coupling device, by means of which a movement of the operating handle can be transferred to a vehicle-side closing assembly, and a locking device serving as a mass locking device, which is attached to the handle mounting and is designed such that, with the effect of an acceleration force, it can block an actuation of the closing assembly by means of the operating handle and/or the coupling device.

Door handle assemblies of this type, having a locking device serving as a mass locking device, are intended to prevent acceleration forces occurring during an accident leading to an actuation of the operating handle, or the door handle, respectively, resulting in an unintended opening of the motor vehicle door, which is accompanied by significant risks for a passenger in the vehicle. With typical door handle assemblies for motor vehicles, the handle components that are to be actuated by a user are mechanically coupled to a vehicle-side closing assembly (the actual door locking device). The movement of the door handle, or the operating handle, respectively, is transferred to the closing assembly by means of the mechanical coupling device, and the door is allowed to open. In the case of an accident, the acceleration forces act, in unfavorable conditions, in the manner of an actuation of the handle components, or the operating handle, respectively, by a user, because the handle can be accelerated toward the direction for opening due to inertia. With an operating handle, or a door handle, respectively, without a corresponding locking device, the movement of the handle components in relation to the vehicle leads to a transference to the closing assembly in the vehicle via the mechanical coupling device, and to a releasing of the door. Example scenarios for such situations normally concern a lateral impact with an obstacle or another vehicle. A locking device, serving as a mass locking device, of this type, which is also referred to as a crash lock, is known from the prior art for door handle assemblies.

By way of example, DE 199 29 022 C2 describes a mass locking device of this type in the form of a pivoting member, which can prevent an actuation of the handle in the event of crash. In the case of an accident, forces are exerted on a locking member, and an unintended movement of the handle, likewise caused by the forces acting thereon, is blocked.

A door handle assembly of the type indicated in the introduction is known, for example, from DE 10 2009 053 553 A1. With this door handle assembly, an additional force acts on the operating handle, or the door handle, respectively, by means of a crash lock, by means of which an unintended movement of the operating handle is to be prevented.

Known crash locks can be designed as a pendulum mass, such that, as a result of the forces acting thereon, the crash lock is shifted into the movement path of the operating handle, thus blocking a movement of the operating handle, wherein the pendulum mass returns to its starting position when a force no longer acts on it. In addition, crash locks are also known that lock in a blocking position, and after they have been activated and locked in position, can only be deactivated by means of a targeted intervention in the door handle unit, such that the door handle can again be used in the normal operation thereof. Normally, the shifting of the crash lock from the activation position to the deactivation position, or a normal operating position, respectively, occurs by means of the automatic return of the operating handle to the starting position.

The invention thus assumes the objective of creating a solution that provides a door handle assembly in a structurally simple manner, and inexpensively, which reliably prevents an unintentional unlocking of the door latch during a vehicle accident.

BRIEF SUMMARY

With a door handle assembly of the type specified in the introduction, the objective is attained according to the invention in that the locking device has a locking element, which is movably coupled to the mechanical coupling device such that, by means of a pivotal movement, the mechanical coupling device of the locking element can rotate about rotational axis, wherein the locking element has at least one locking member attached thereto, which is designed to block the rotational movement of the locking element when a predetermined displacement speed for the operating handle has been exceeded.

Advantageous and practical designs and further developments of the invention can be derived from the dependent claims.

By means of the invention, a door handle assembly for a motor vehicle, and in particular a centrifugal force lock, dependent on the actuation speed of the operating handle, is provided, which is distinguished by the functional construction, and a simple and inexpensive assembly. In differing from the mass locking devices and crash locks known from the prior art, which move into the movement path of the operating handle or a coupling device coupled to the operating handle when activated as the result of an acceleration force acting thereon, and accordingly block a displacement of the operating handle, or the coupling device, respectively, a connecting element is provided in the framework of the invention, which can be a cord or a rod, and which movably couples the coupling device to the locking element. Because of this movable coupling, a pivotal movement of the mechanical coupling device results in a rotational movement of the locking element. As a result of the rotational movement of the locking element, a mass force, which can also be referred to as an inertia force, or centrifugal force, acts on the at least one locking member. When a predetermined displacement speed for the operating handle has been exceeded, a correspondingly fast displacement of the coupling device occurs, by means of which the connecting element causes a correspondingly fast rotational movement of the locking element, such that the at least one locking member is displaced as a result of the mass force that has become active in such a manner that a rotational movement of the locking element is blocked, as a result of which, in turn, a further displacement of the coupling device and the operating handle coupled thereto is prevented. In this manner, it is effectively and securely prevented that the door lock can be opened unintentionally in the event of a vehicle accident. The locking device is disposed at a location within the functional connection between the closing assembly and the operating handle, wherein the locking element, instead of being coupled to the coupling device, can also be coupled to the operating handle by another means. It is only important that the locking device effectively blocks the action of the operating handle when a predetermined displacement speed has been exceeded, in order that the displacement movement of the operating handle is not accompanied by an actuation of the closing assembly. In other words, the locking device is coupled to the operating handle, and designed such that it interrupts a functional connection, which can be a Bowden cable, for example, between the closing assembly and the operating handle, if a predetermined displacement speed for the operating handle has been exceeded.

In order to keep the dimensions of the different elements of the door handle assembly small, and thus keep the costs low, it is provided in the design of the invention that a first longitudinal end of the connecting element engages with the rotational axis of the locking element, and the other, second longitudinal end of the connecting element is attached to the mechanical coupling device at a spacing to its pivotal axis. The connecting element attached thereto can be designed as a cord or a rod. Because the connecting element engages with the rotational axis of the locking element, the connecting element acts as a kind of transmission, by means of which the connecting element rotates the locking element with a greater gear ratio, with a rotational axis having a small diameter, such that a relatively high rotational speed acts on the locking element. In this manner, the at least one locking member, for example, can be designed as a blocking element relying on centrifugal force, which changes its position when the locking element exceeds a defined rotational speed, and thus blocks a further rotational movement of the locking element.

In an advantageous design, the invention provides that at least one locking member is designed in the form of a lever, and is mounted such that one of its two end surfaces is radially offset in relation to the rotational axis of the locking element at a point of rotation that moves together with the locking element, such that it can rotate between a normal operating position, which releases a rotational movement of the locking element, and a blocking position, which blocks a rotational movement of the locking element. The locking member can be designed such that it is in the shape of a ratchet, having a lever with a single arm, mounted such that it can rotate about a journal, serving to inhibit the movement of the locking element, wherein the normal operating position can be maintained by means of spring forces, while the blocking position can be assumed as a result of centrifugal force.

Accordingly, in the design of the invention an elastic spring element is provided, which exerts a force keeping the at least one locking member in the normal operating position, wherein the at least one locking member is designed to move the operating handle, against the force of the elastic spring element, radially away from the rotational axis, and to a blocking contour, in its blocking position. In its blocking position, the locking member engages in a form and/or force locking connection with the blocking contour, in order to inhibit, or block, a further rotational movement of the locking device.

As is known from accident research results, alternating acceleration forces may occur during a lateral collision, which lead to a kind of fluttering of the door handle assembly. As a result of this fluttering, it may be possible that the locking member only lies against the blocking contour temporarily, such that the danger of an unintended unlocking of the door lock may then exist. In this regard, in a more detailed design, the invention provides that the elastic spring element is a leg spring or an over-center spring supported on the locking element and the locking member, which exerts a force that moves the at least one locking member into either the normal operating position or the blocking position, and is disposed such that it is offset to the point of rotation for the locking member. By means of the spring element, the at least one locking member is displaced once from the normal operating position to the blocking position when a predetermined displacement speed of the operating handle has been exceeded as the result of an accident, and remains in the blocking position, in particular because the spring element is disposed such that it is offset to the point of rotation for the locking member, and by passing through a dead-point position, the force of the spring element causes the locking member to move into the blocking position. Because the alternating acceleration forces diminish quickly, the danger of a returning of the at least one locking member as the result of alternating acceleration forces is nonexistent.

A structurally particularly beneficial possibility for the configuration of the locking element on the door handle assembly, with a minimal assembly space, is provided in the design of the invention in that the locking device has a housing shell attached to the handle mounting, in which the locking element is rotatably mounted, wherein the blocking contour is designed as at least a radially, outward extending, and disposed outside of the movement path of the locking element, convexity on the encasing wall of the housing shell. As long as the movement speed of the operating handle does not exceed the predetermined displacement speed when displacing the operating handle, then the at least one locking member is held back by means of the spring element, and remains in the normal operating position. If, however, the speed with which the operating handle is displaced exceeds the predetermined displacement speed, then the at least one locking member is pivoted radially away from the rotational axis, due to the prevailing centrifugal force, which overcomes the spring force, and can end up in contact with the blocking contour, such that a further rotation of the locking element is inhibited, thus blocking a displacement of the operating handle, which is movably coupled to the coupling device.

In order to avoid an imbalance, it is advantageous in further designs of the invention if the locking element is designed in the manner of a lever, having two radially opposed locking members. The locking members provide a mass that is distributed rotation-symmetrically on the lever-shaped locking element in accordance with the provided design.

In order that the locking device, functioning as a mass locking device or centrifugal force locking device, can still be used after an activation thereof, the invention provides, in another design, that a spring-type return element is provided, which exerts a return force that pushes the locking element back into a starting position, in which the operating handle is not displaced, wherein the return force from the return element is greater than the force from the elastic spring element. As a result of returning the locking element to the starting position, a renewed activation of the locking device can occur.

In order that not only the locking element, rotated out of its starting position, but also the at least one locking member, can be returned to the normal operating position, it is advantageous if, in a design of the invention, the door handle assembly is provided with a return contour, which guides the at least one locking member out of the blocking position back into the starting position when the locking element is returned to its starting position. The return contour can, for practical purposes, as is the case with the blocking contour, be formed on the encasing wall of the housing shell.

The structural design of the door handle assembly according to the invention allows for a certain flexibility, such as, for example, the possibility that a Bowden device, actuating the vehicle-side closing assembly, is functionally connected to either the locking element or the mechanical coupling device.

Furthermore, for a secure and reliable activation of the locking device, it is provided that the predetermined displacement speed of the operating handle is a least 2 m/sec. This basically corresponds to a maximum speed for manually operating the operating handle, while in contrast, the minimum speed for the displacement of the operating handle in the case of a vehicle accident is at least 5.4 m/sec. For this reason, alternatively, the predetermined displacement speed for the operating handle should be at least 5 m/sec., in order to prevent a premature activation of the locking device.

In order for the acceleration forces resulting from a vehicle accident to have no direct effect on the displacement of the at least one locking member, i.e. in order that the at least one locking member is displaced only because of the rotational movement of the locking element, and the centrifugal force resulting therefrom, the invention furthermore provides in its design that the rotational axis is oriented substantially transverse to the pivotal axis of the mechanical coupling device.

It is to be understood that the features specified above, and the features to be explained below, can be used not only in the respective given combinations, but also in other combinations, or in and of themselves, without abandoning the scope of the present invention. The scope of the invention is defined only by the claims.

BRIEF DESCRIPTION OF THE DRAWINGS

Further details, features and advantages of the subject matter of the invention can be derived from the following description in conjunction with the drawings, in which exemplary, advantageous embodiment examples of the invention are depicted. Shown in the drawings are.

DETAILED DESCRIPTION

Figure 1:
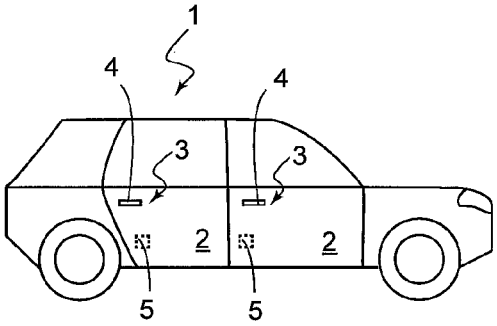
FIG. 1: a side view of a motor vehicle having numerous door handle assemblies according to the invention.
Figure 2:
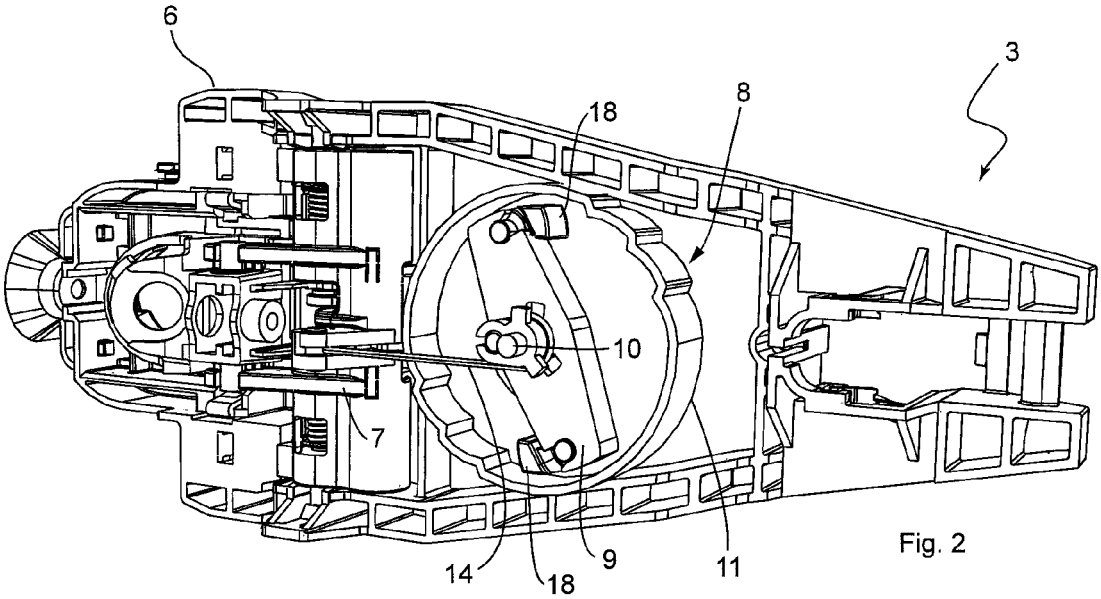
FIG. 2: a perspective view of a door handle assembly according to the invention, in accordance with a first embodiment of the invention.
Figure 3:
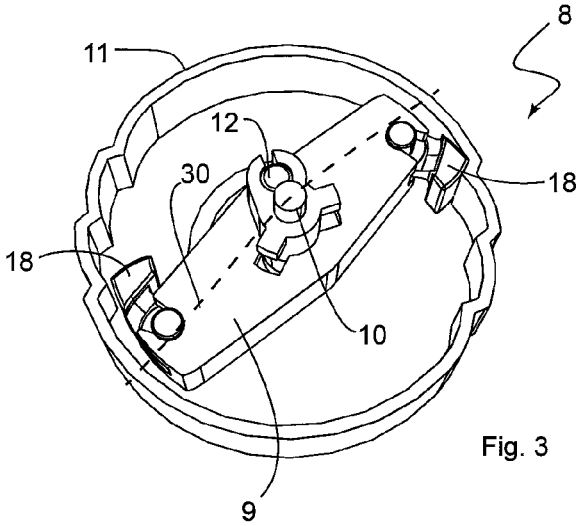
FIG. 3: a perspective view of a locking device for the door handle assembly, according to the first embodiment.

A vehicle, or motor vehicle 1, respectively, in the form of a passenger car, is depicted by way of example in FIG. 1, which has four doors 2 in the example, which can be opened by means of a door handle assembly 3, and in particular, can be opened by means of a door handle, or an operating handle 4, respectively. The doors 2 are firmly closed by means of respective closing assemblies 5, and can only be opened from the outside by means of a respective movement of the operating handle 4. This movement at the operating handle 4 can consist of a pulling and/or lifting movement, wherein the corresponding movement of the operating handle 4 is mechanically transferred, at least by means of a coupling device, onto the corresponding closing assembly 5. By means of the movement of the operating handle 4, the corresponding closing assembly 5, and thus the door 2 associated therewith, can then be opened.

In FIGS. 2-8, a door handle assembly 3 according to a first embodiment is shown in greater detail, and in FIGS. 9-15, a door handle assembly according to a second embodiment is shown in greater detail, in each case in a perspective view. The following description relates to the door handle assembly 3, both according to the first as well as the second embodiment, wherein the differences shall be discussed explicitly. The respective door handle assemblies 3, i.e. the door handle assembly 3 according to the first and second embodiments, has a frame-like handle mounting 6, wherein, for reasons of clarity, a depiction of the operating handle 4 shall be omitted in the FIGS. 2-8 for the first embodiment, and in the FIGS. 9-15 for the second embodiment. The frame-like handle mounting 6 serves in the known manner for the attachment of the operating handle 4, and is attached to the door panel on the inner surface thereof by means of threaded fasteners, not shown in greater detail, wherein the operating handle 4 is disposed on the outer surface of the door. The handle mounting 6 is substantially formed by a frame structure in order to save on material, and includes various receiving and bearing spaces, in order to be able to accommodate, aside from the operating handle 4, which is movably and/or pivotally mounted on the handle mounting 6 for opening a corresponding door 2 of the motor vehicle 1 by a user, a mechanical coupling device 7 and a locking device 8 (see FIGS. 3 and 10, for example), as well as, optionally, a lock cylinder, not shown in greater detail in the figures. A movement of the operating handle 4 can be transferred to the corresponding vehicle-side closing assembly 5 by means of the mechanical coupling device 7, in order, by this means, to open the corresponding door 2. The locking device 8, serving as a mass locking device, is designed such that, with the effects of a force, such as an acceleration force, it blocks an actuation of the closing assembly 5 by means of the operating handle 4, and/or by means of the coupling device 7 through an actuation of the operating handle 4.

Figure 4:
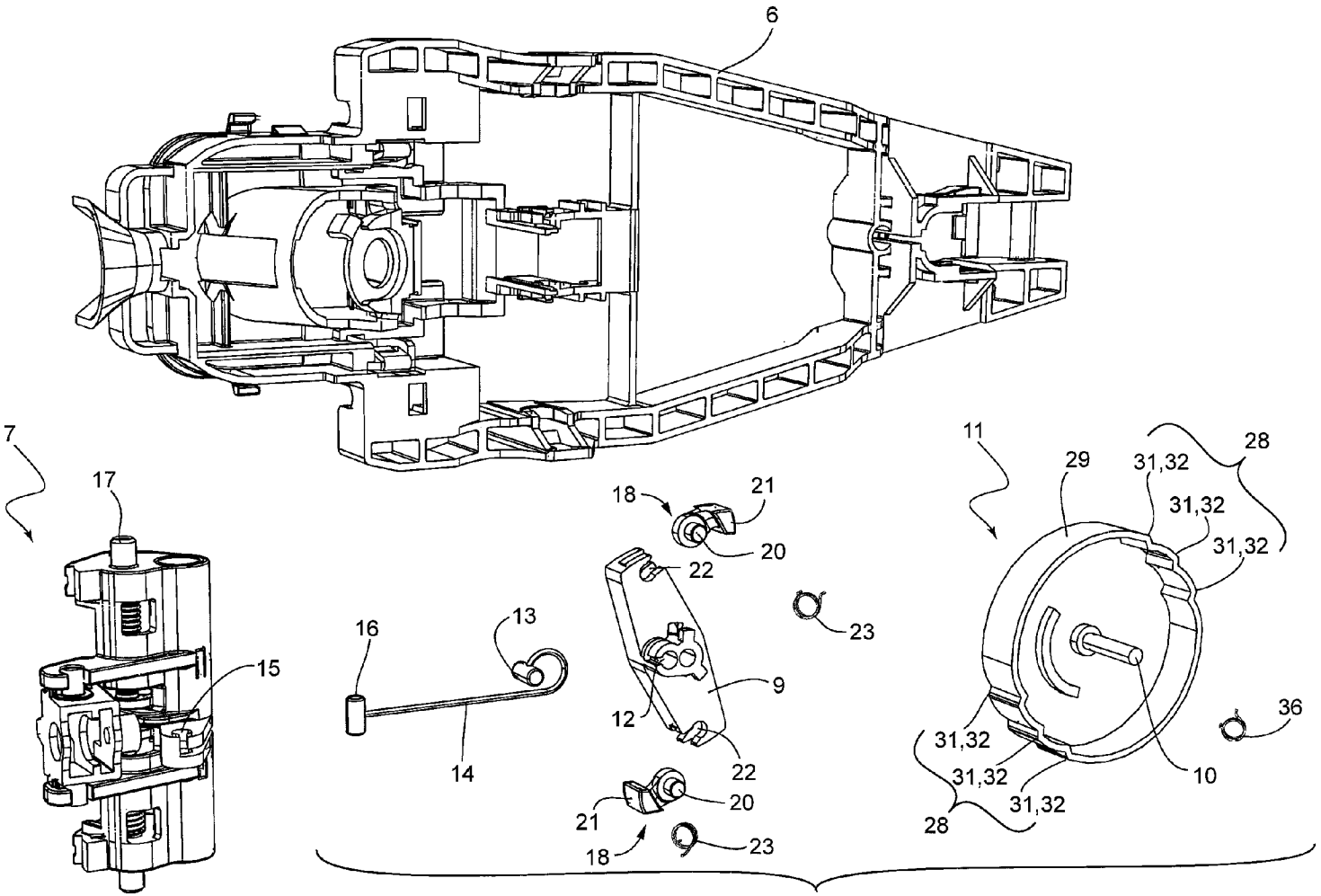
FIG. 4: a perspective exploded view of the door handle assembly according to the first embodiment.
Figure 11:
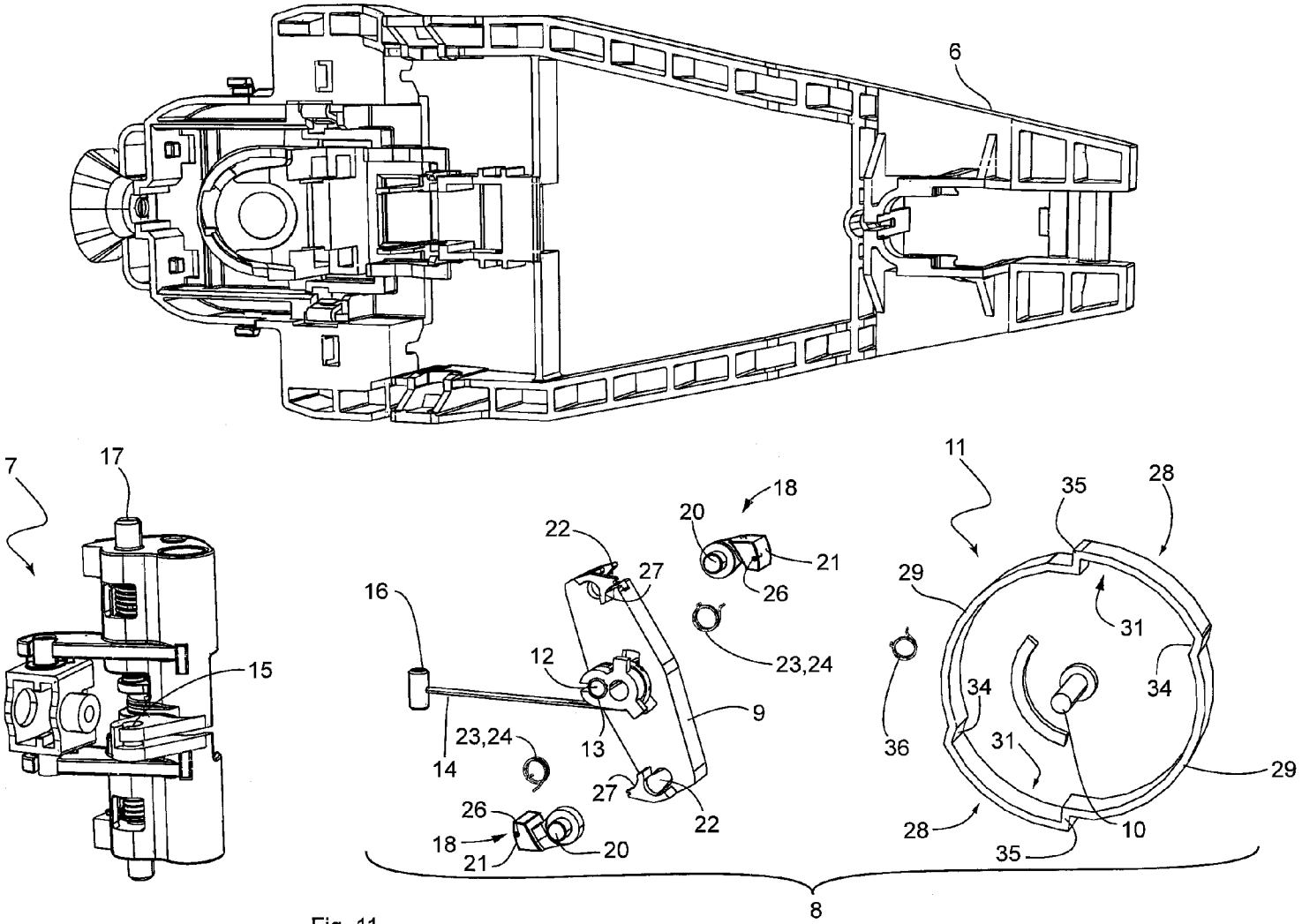
FIG. 11: a perspective exploded view of the door handle assembly according to the second embodiment.

As can be further derived from FIGS. 4 and 11, which show the door handle assembly 3 according to the first and second embodiments, in each case in an exploded view, the locking device 8 has a lever shaped locking element 9, which is supported at its center on, and can rotate about, a rotational axis 10. The rotational axis 10 is formed on a shell-like housing, or housing shell 11, respectively, which is part of the locking device 8, wherein the housing shell 11 is attached to the handle mounting 6 when the door handle assembly 3 is in the installed state. The locking element 9 is supported such that it can rotate about the rotational axis 10 in the housing shell 11. The locking element 9, which is designed in the manner of a ratchet lever, has a stop recess 12, which receives a first longitudinal end 13 of a connecting element 14. In other words, the first longitudinal end 13 of the connecting element 14 engages with the rotational axis 10 of the locking element 9. The stop recess 12 thus serves as a catch for the connecting element 14 in the ratchet lever, or the locking element 9, respectively. The locking element 9 is movably coupled to the mechanical coupling device 7 via the connecting element 14. For this purpose, the mechanical coupling device 7 has a seat 15, disposed such that it is offset in relation to its pivot axis 17, for the second longitudinal end 16 of the connecting element 14 (see FIGS. 4 and 11, by way of example). The seat 15 thus represents an additional attachment point for the connecting element 14 on the coupling device 7 designed in the manner of pivot arm. Thus, the second longitudinal end 16 of the connecting element 14 is attached to the mechanical coupling device 7 at a spacing to its pivot axis 17. The mechanical coupling device 7 is supported on the handle mounting 6 such that it can rotate about the pivot axis 17, such that an actuation of the operating handle 4 results in a pivotal movement of the mechanical coupling device 7. The pivoting of the coupling device 7 about the pivot axis 17 causes a rotational movement of the locking element 9 about the rotational axis 10, due to the movably coupled connection of the coupling device 7 and the locking element 9 via the connecting element 14, during normal actuation of the operating handle. A normal actuation of the operating handle 4 is understood here to be an actuation by a user, in which the operating handle 4 is pulled by a user by hand with a maximum speed, or maximum displacement speed, of 2 msec. This displacement speed during the actuation of the operating handle 4 is transferred, via the coupling device 7, by means of the connecting element 14, to the locking element 9, such that this locking element rotates with a corresponding rotational speed about the rotational axis 10. In doing so, the connecting element 14 acts as a transmission acting on the mechanical coupling device 7, which displaces the locking element 8 in a rotation with a high gear ratio (smaller diameter of the load cable and smaller diameter of the rotational axis 10), such that a high rotational speed in relation to the displacement speed of the operating handle 4 can be obtained.

In the event of a vehicle accident, the locking device 8 should then prevent an actuation of the operating handle 4 in that at least one locking member 18 is provided, which blocks the rotational movement of the locking element 9 when a predetermined displacement speed of the operating handle 4 has been exceeded. This is implemented, in the two embodiments shown, by means of two locking members 18, which are attached to the locking element 9, designed in the manner of a lever, such that they are radially opposite one another. As a matter of course, alternatively only one locking member, or numerous locking members could be provided, wherein, however, two locking members 18 would seem to be advantageous for avoiding an imbalance. The two locking members 18 are designed in the manner of a lever, or pawl, and are rotatably attached at one of their two ends, radially offset to the rotational axis 10 on the locking element 9, at a respective point of rotation 19, which moves together with the locking element 9 when it rotates. A respective point of rotation 19 is not only radially offset to the rotational axis 10, but is also disposed on the locking element 9, offset in the circumferential direction in relation to an imaginary midline 30, which is drawn in the longitudinal direction of the locking element 9 in FIGS. 3 and 10. A respective locking member 18 is supported, in both the first as well as the second embodiment, between a normal operating position, enabling a first rotational movement of the locking element (see FIGS. 6 and 13, by way of example), and a blocking position, blocking a rotational movement of the locking element 9 (see the upper locking element 9 in FIGS. 8 and 14, by way of example). In order to fulfill this function, a respective locking member 18 has a pin 20 on its lever-shaped body, formed at the end thereof, which defines the point of rotation 19. A blocking projection 21 is formed on the end of a respective locking member lying opposite the pin 20. The pin 20 of the respective locking member 18 is rotatably supported in a corresponding bearing seat 22 formed in the locking element 9. In the normal operating position, a respective locking member 18 is disposed, by means of the action of a spring force, in the position shown in FIGS. 5 and 12, for example. In the normal operating position, a respective locking member 18 is supported on the locking element 9 in the folded-down position, such that the respective locking member 18 does not extend over the outer edge of the locking element 9, or beyond its longitudinal extension, respectively, by means of which it is ensured that the locking element 9 can rotate about the rotational axis 10, without a respective locking member 18 extending beyond the outer edge of the locking element 9, and thus blocking the rotational movement of the locking element 9. This blocking position, i.e. the blocking position, is first assumed by a respective locking member 18 when a predetermined displacement speed of the operating handle 4 has been exceeded. The predetermined displacement speed of the operating handle 4 should be at least 2 m/sec. Because, however, typical displacement speeds during a vehicle accident, as a result of the effects of acceleration forces, are substantially higher, and amount to at least 5.4 m/sec., the predetermined displacement speed for the operating handle 4 can, alternatively, be at least 5 m/sec., in order to prevent a premature activation of the locking device 8. An elastic spring element 23 is dimensioned in accordance with the predetermined displacement speed of the operating handle, by means of which an accident situation is indicated, said elastic spring element being depicted in the respective exploded views in FIGS. 4 and 11 for the first and second embodiments. The force with which the spring element 23 pushes a respective locking member 18 into the normal operating position is determined on the basis of the predetermined displacement speed. As soon as the predetermined displacement speed has been reached, the centrifugal force acting on the respective locking member 18 exceeds the force of the elastic spring element 23, such that a respective locking member 18 can move from the normal operating position to the blocking position as a result of centrifugal force.

With the first embodiment of the door handle assembly 3 according to FIGS. 2-8, the elastic spring element 23 is disposed at the point of rotation 19 about the pin 20 of a respective locking member 18, and exerts the force pushing the locking member 18 into the normal operating position.

In contrast to this, with the second embodiment the door handle assembly 3 according to FIGS. 9-15, the elastic spring element 23 is designed as a leg spring 24, the ends of which rest against the locking element 9 and the locking member 18. The leg spring 24 is disposed radially offset to the point of rotation 19 of a respective locking member 18 in the second embodiment; in particular, a first end 25 (see FIG. 10) of the leg spring 24 is rotatably supported, radially offset to the point of rotation 19, on a point of rotation 26 for the spring (see FIG. 11) of the locking element 8. In the normal operating position, the leg spring 24 lies in sections on a supporting surface 27 (see FIG. 10 or 11, by way of example) formed on the locking element 9, and is shaped in the manner of an arc segment, wherein, in this position, the leg spring 24 exerts a force pushing the locking member 18 into the normal operating position. As a result of the effect of centrifugal force when the predetermined displacement speed has been exceeded, not only is the respective locking member 18 pivoted and displaced about the point of rotation 19, but also the leg spring 24, designed in the manner of an over-center spring, is rotated about the point of rotation 26 for the spring. When the leg spring 24 rotates, it passes through a type of dead-point position, by means of which the force of the leg spring then pushes the respective locking member 18 into the blocking position, and retains it there. With the second embodiment of the door handle assembly 3 according to the invention, it is accordingly provided that a respective locking member 18 assumes two defined positions in relation to the displacement speed of the operating handle 4, specifically, the normal operating position, in which the displacement speed of the operating handle does not exceed the predetermined displacement speed, and the blocking position, in which, in the event of a vehicle accident, the predetermined displacement speed has been reached and exceeded.

The function of the respective locking element 18 in the first and second embodiments of the door handle assembly 3 consists of blocking the rotational movement of the locking element 9 when the operating handle 4 is displaced such that the predetermined displacement speed of the operating handle 4 has been reached and exceeded. As explained above, when the predetermined displacement speed of the operating handle 4 has been exceeded, a respective locking member 18 is moved from the normal operating position into the blocking position, which is directed radially away from the rotational axis 10 about the point of rotation 19 as a result of the effects of centrifugal force in a rotational movement of the respective locking member 18. In order for a respective locking element 18 to be able to block the rotational movement of the locking element 9 about the rotational axis 10, the blocking projection 21 of the respective locking member 18 is moved to a position resting against a blocking contour 28. In the simplest case, the blocking contour 28 can be the encasing wall 29 of the housing shell 11, at which a respective locking member 18 becomes jammed, or blocks the rotational movement of the locking element 9 by means of a form-locking connection, or coupling, respectively, of the locking element 9 and the locking member 18 as a result of friction applied thereto.

Instead of a form-locking connection, or coupling, respectively, a force-locking connection, or coupling, respectively, between the locking element 9 and a respective locking member 18 is provided in the two embodiments of the door handle assembly 3. This force-locking connection is implemented in both embodiments by means of a molding in the encasing wall 29 of the housing shell 11, as shall be explained below.

Figure 5:
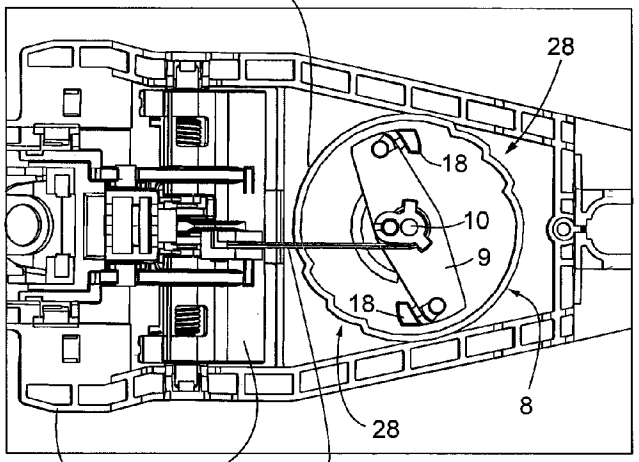
FIG. 5: a side view of the door handle assembly according to the first embodiment, with a locking element in its starting position.
Figure 6:
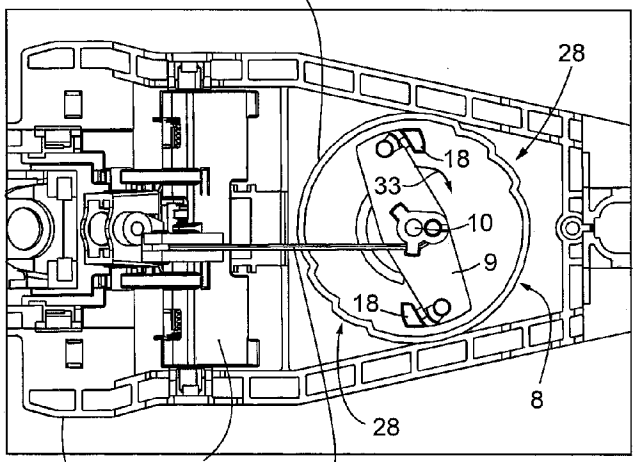
FIG. 6: a side view of the door handle assembly according to the first embodiment, with the locking element rotated to the maximum extent.
Figure 7:
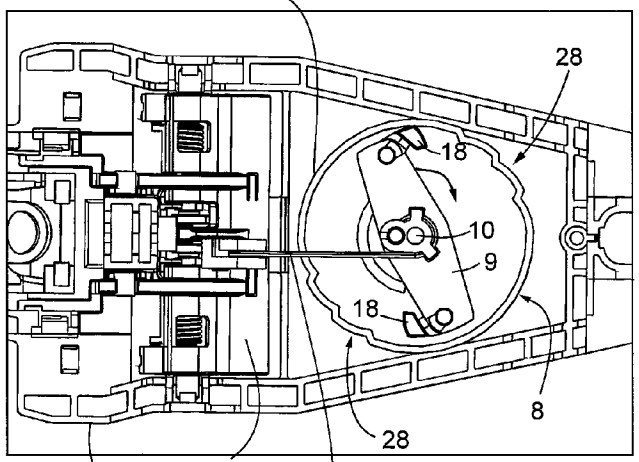
FIG. 7: a side view of the door handle assembly according to the first embodiment, in a crash situation, with a locking member of the locking element being displaced.
Figure 8:
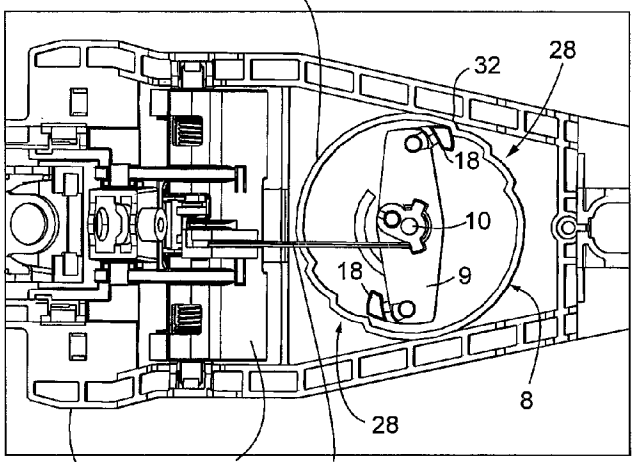
FIG. 8: a side view of the door handle assembly according to the first embodiment, in a crash situation, with the locking element blocked, and the coupling device blocked.
Figure 9:
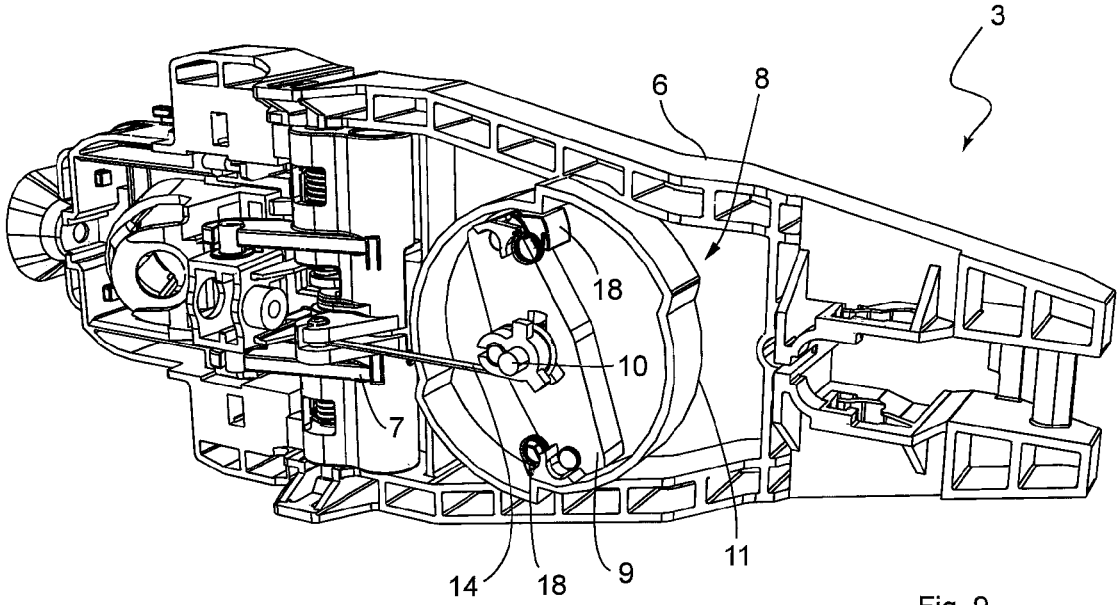
FIG. 9: a perspective view of a door handle assembly according to the invention, in accordance with a second embodiment.
Figure 10:
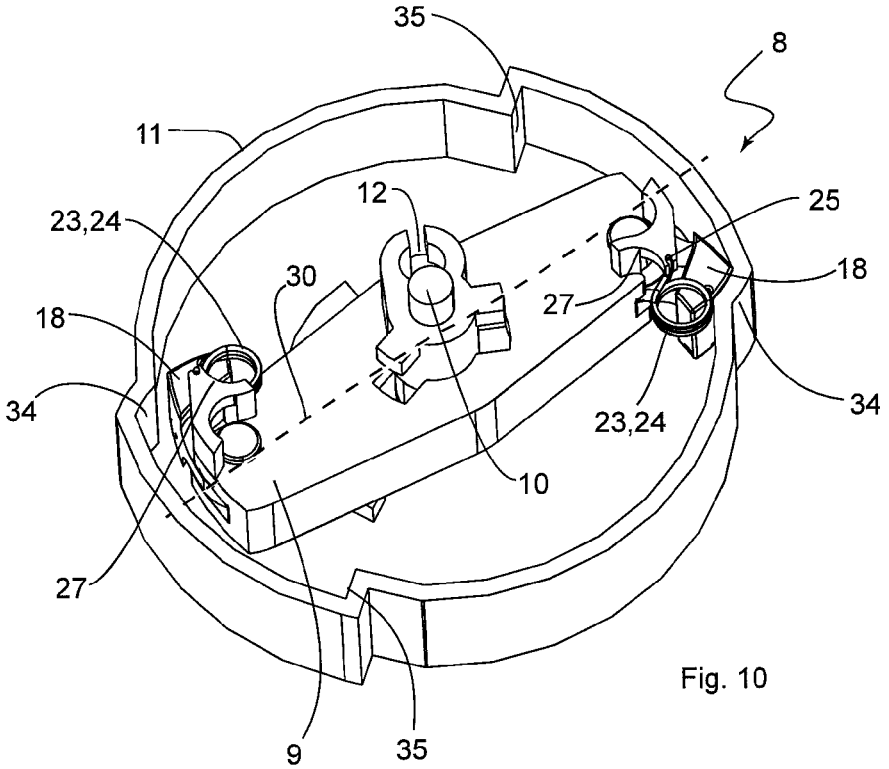
FIG. 10: a perspective view of a locking device for the door handle assembly according to the second embodiment.

In reference to the first embodiment of the door handle assembly 3 according to the invention, shown in FIGS. 2-8, the encasing wall 29 of the housing shell 11 is provided with convexities 31 in the form of ratchet teeth 32 facing radially outward. In the first embodiment of the door handle assembly 3, three ratchet teeth 32 are allocated to each respective locking element 18, which are formed such that they lie successively on the circumference of the encasing wall 29, such that even in the case that a respective locking element 18 does not engage with the first ratchet tooth 32, the locking element 18, which has been displaced by the effects of centrifugal force, can still engage with one of the other two ratchet teeth, in order to prevent a further rotational movement of the locking element 9 in the event of a vehicle accident. Different situations for the door handle assembly 3 according to the first embodiment are depicted in FIGS. 5-8, based on which the functional principle shall now be explained in greater detail. FIG. 5 shows the door handle assembly 3 in the resting state, when the operating handle 4 has not been actuated, and the mechanical coupling device 7 has not been actuated, wherein, when the locking device 8 is inactive, the respective locking members 18 are in their folded-in, normal operating position. In FIG. 6, a situation for the door handle assembly 3 according to the first embodiment, in which no accident has occurred, is shown, in which the locking device 8 is inactive, and the operating handle 4 is displaced with a displacement speed of less than 2 m/sec., until it has reached the endpoint, by means of which the mechanical coupling device 7 pivots about the pivotal axis 17, and moves the connecting element 14, such that the locking element 9 rotates in the clockwise direction, corresponding to the direction of the arrow 33. In FIG. 6 the locking element 9 is rotated 180° in relation to the resting position, and is located in the position in which the vehicle-side closing assembly 5 for opening the door 2 is actuated. FIGS. 7 and 8 relate to situations in which a vehicle accident has occurred, and an acceleration force acts on the operating handle 4, by means of which this operating handle is displaced at a speed that exceeds the predetermined displacement speed, thus at least 2 m/sec., preferably at least 5 m/sec. As a result of the displacement of the operating handle 4, a force is transferred to the locking element via the functional chain, which is formed by the coupling device 7, coupled to the operating handle 4, and the connecting element 14 connected to the mechanical coupling device 7, by means of which the operating handle is displaced in rotation in the clockwise direction. FIG. 7 shows a state in which the locking device 8 is still inactive, regardless of whether a vehicle crash has occurred. In this state, the upper of the two locking members 18 is displaced toward the encasing wall 29 of the housing shell 11, while the lower locking member 18, in contrast, remains in the resting position, i.e. in its normal operating position, due to overlapping accelerations. In FIG. 8, the lower locking member 18 still remains in its normal operating position. However, the locking device in FIG. 8 is activated, because the upper locking member 18 is now engaged with the first of the three ratchet teeth 32 disposed successively on the circumference, by means of which the displaced locking member 18 blocks a further displacement of the mechanical coupling device 7, and thus the operating handle 4, such that an actuation of the closing assembly 5 and an opening of the door 2 is not possible. As can be seen in FIG. 8, it is sufficient if only one of the two locking members 18 is engaged with one of the ratchet teeth 32, in order to bring about the desired blocking. The locking device 8 according to the first embodiment can only be deactivated after it has been activated by means of a targeted intervention in the door handle assembly 3, in order to again enable the use of the door handle in normal operation. Normally, the displacement of the locking device 8 from the activation position to a deactivation position, or to the normal operating position of the locking member 18, respectively, is attained by means of trained personnel in a repair shop. An automatic return of the locking member 3 [sic: 18] to the normal operating position is not provided for with the door handle assembly 3 according to the first embodiment.

Figure 13:
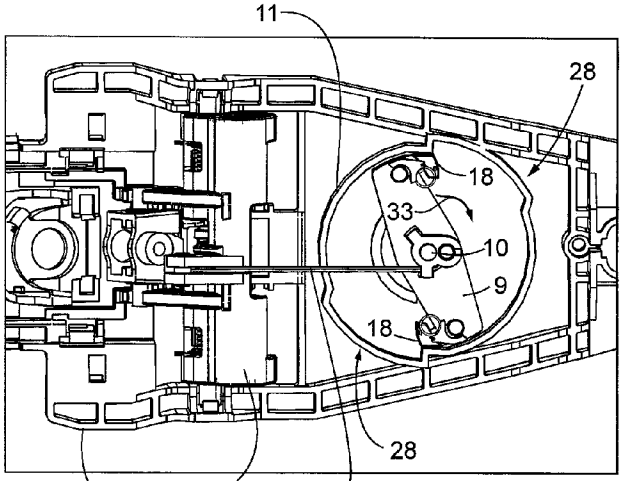
FIG. 13: a side view of the door handle assembly according to the second embodiment, with the locking element rotated to the maximum extent.
Figure 12:
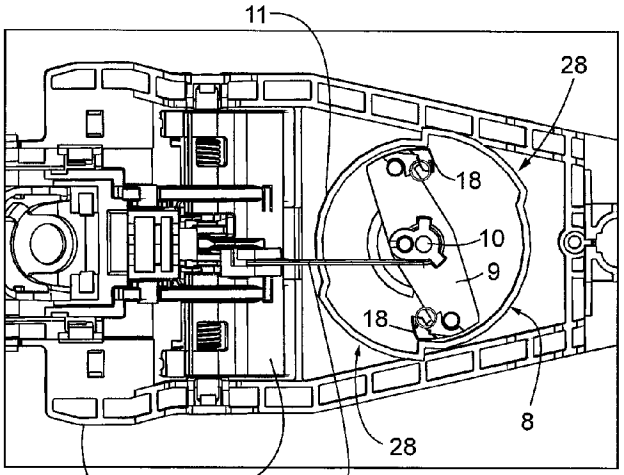
FIG. 12: a side view of the door handle assembly according to the second embodiment, with the locking device in its starting position.
Figure 15:
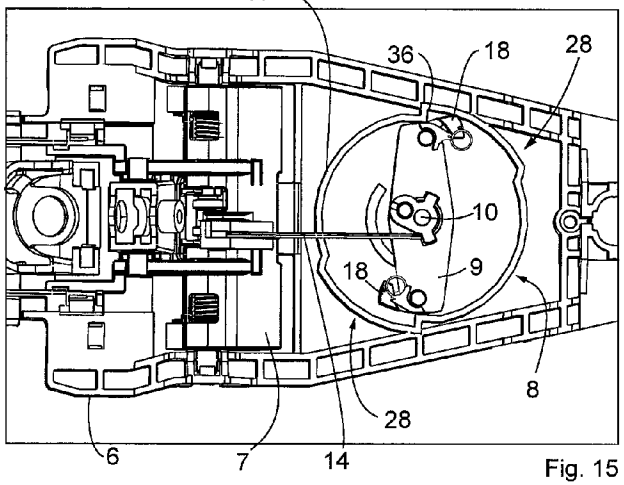
FIG. 15: a side view of the door handle assembly according to the second embodiment, with the locking member being returned.
Figure 14:
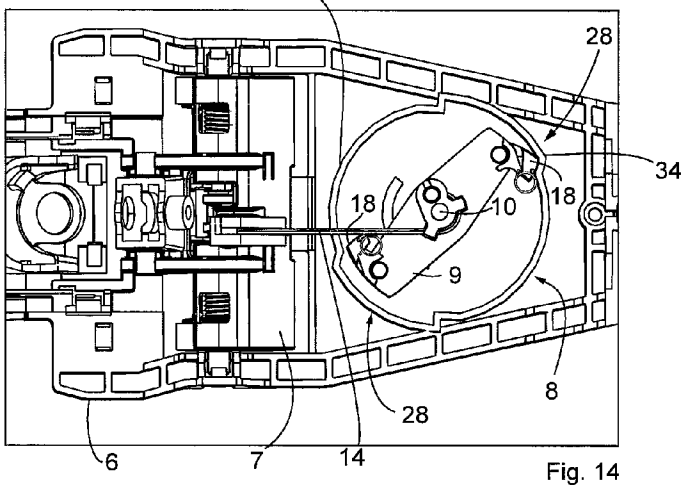
FIG. 14: a side view of the door handle assembly according to the second embodiment, in a crash situation, with the locking element blocked, and with the coupling device blocked.

In contrast to this, with the door handle assembly 3 according to the second embodiment, shown in FIGS. 9-15, a possibility for the return of the locking member 18, and thus an automatic deactivation of the locking device 8, is provided. For this purpose, the blocking contour 28 is designed as a single convexity 31 on the encasing wall 29, having a single blocking surface 34 (instead of three ratchet teeth 32), as shown in FIG. 11, wherein the contour and configuration of the blocking surface 34 is substantially the same as the rearmost of the three ratchet teeth 32 on the circumference, in the first embodiment. For the return, a return contour 35 is provided, which is a part of the convexity 31 of the blocking contour 28, and is designed as a step-shaped transition to the encasing wall 29 of the housing shell 11 at the start of the convexity 31. The step-shaped return contour 35 is formed at basically the same level as the first ratchet tooth 32 of the first embodiment. For the return, moreover, a spring-type return element 36 is provided, which exerts a return force that pushes the locking element 9 back into the starting position, in which the operating handle 4 is not displaced. It should be noted that, with the first embodiment of the door handle assembly 3 as well, a spring-type return element 36 is provided, in order, if applicable, to automatically guide the locking element 9 back to its starting position. In order for the a locking member 18 that has been displaced to the blocking position, which can only be disposed in the normal operating position or the blocking position (but not, however, in an intermediate position) because of the over-center spring, or leg spring, respectively, to be returned to the normal operating position, it is necessary that the return force of the return element 36 is greater than the force of the elastic spring element 23, or than the force of the over-center spring, or leg spring 24, respectively. In FIG. 12, the door handle assembly 3 of the second embodiment is shown in the resting position, with the operating handle 4 not actuated, and the mechanical coupling device 7 not pivoted. The locking device is thus inactive, such that the respective locking members 18 are located in their folded-in normal operating position. In FIG. 13 as well, the locking device 8 is inactive, but the operating handle 4 has been actuated, as can be seen by the pivoted coupling device. In FIG. 13, the operating handle 4 has been displaced to the endpoint by a user, at a displacement speed of less than 2 m/sec., thus at a lower speed than the predetermined displacement speed, such that the locking element 9 is rotated about the rotational axis 10 in the clockwise direction, corresponding to the arrow 33 in FIG. 13, by means of the connecting element 14. In the situation shown in FIG. 13, the locking element 9 is rotated 180° in relation to the resting position, and is located in the position in which the vehicle-side closing assembly for opening the door 2 is actuated. FIG. 14 relates to an accident situation of the motor vehicle, in which an acceleration force acts on the operating handle 4, such that this operating handle is displaced with a speed that is greater than the predetermined displacement speed, of at least 2 msec. Due to the displacement of the operating handle 4, a force is transferred to the locking element 8 by means of the functional chain formed by the operating handle 4, the coupling device 7, and the connecting element 14, by means of which the locking device rotates in the clockwise direction. In FIG. 14, the lower locking member 18 is located in its normal operating position, despite the activated locking device 8, which can occur as a result of overlapping accelerations. The upper locking member 18 is engaged by means of its blocking projection 21 with the blocking surface 34, by means of which the displaced locking member 18 blocks a further displacement of the mechanical coupling device 7, and thus the operating handle 4. An actuation of the closing assembly 5 and an opening of the door 2 are thus not possible. With a rotating of the locking member 18 along the convexity 31, it must be decided, based on the speed at which the operating handle 4 is displaced, whether the centrifugal force acting on the locking device 8 is strong enough to move a respective locking member 18 from the normal operating position to the blocking position. As soon as the locking element 9 has rotated past the region of the convexity 31 having the blocking contour 28, an activation of the locking device 8 is no longer possible. In FIG. 15, lastly, the situation in which a locking member 18 is returned is shown. Due to the force exerted by the return element 36, designed as a spring, for returning the locking element 9 to its starting position, shown in FIG. 12, the displaced locking member 18 ends up resting against the return contour 35. Because the return force of the return element 36 is greater than the force of the elastic spring element 23, the upper locking member 18 is again returned from the blocking position to the normal operating position, such that the locking element 9 can rotate back to the starting position.

With both embodiments described above, a Bowden pulling device actuating the vehicle-side closing assembly 5 is functionally connected to either the locking element 9 or the mechanical coupling device 7. Likewise, it is common to both embodiments that the rotational axis 10 of the locking element 9 is aligned substantially transverse to the pivot axis 17 of the mechanical coupling device 7, such that acceleration forces acting in the direction of the rotational axis 10 exert no direct effect on the locking members 18, such that the displacement of the locking members 18 is dependent solely on the centrifugal force, which in turn is determined by the displacement speed of the operating handle 4.

In summary, a centrifugal force lock, or locking device 8, respectively, for a door handle assembly 3 of a motor vehicle 2 is presented above, in which a locking element 9 is rotatably supported in the manner of a ratchet lever, and is provided at the ends with locking members 18 in the form of latches, which pivot radially outward when subjected to a sufficiently strong centrifugal force, and as a result, come to lie against a blocking contour 28, which can be formed by ratchet teeth 32 or by a single blocking surface 34, by means of which a further rotational movement of the locking element 9 can be blocked. The locking device 8 is disposed at a position within the functional connection between the closing assembly 5 and the operating handle 4, and coupled to the operating handle 4 such that it interrupts the functional connection, which can be a Bowden cable, for example, if a predetermined displacement speed of the operating handle has been exceeded. The transmission, applied to the mechanical coupling device 7 in the form of the connecting element 14 in the embodiments, causes the locking element 9 to rotate/turn, such that a high rotation speed is obtained. The locking element 9, having the latch in the form of the locking member 18, actuated by means of centrifugal force, then latches into the blocking contour 28. An automatic return of the locking member 18 for a locking and automatically deactivating locking device, or centrifugal force lock 8, respectively, is explained based on the more detailed description of the second embodiment. Both the first embodiment as well as the second embodiment are based on a centrifugal force lock 8, which is dependent on the handle speed, i.e. the activation of the centrifugal force lock 8 is dependent on the speed at which the operating handle is moved.

The invention described above is, of course, not limited to the described and illustrated embodiments. It is obvious that numerous modifications, obvious to the person skilled in the art regarding the intended applications, can be made to the embodiments depicted in the drawings, without abandoning the field of the invention thereby. All that is contained in the description and/or depicted in the drawings, including that which is obvious to the person skilled in the art, deviating from the concrete embodiment examples, belongs to the invention thereby.

The invention claimed is:

1. A door handle assembly for a motor vehicle, comprising:

a frame-like handle mounting, an operating handle, which is moveably supported on the handle mounting for the opening of a door or a hatch on the motor vehicle by a user, a mechanical coupling device, by means of which a movement of the operating handle can be transferred to a vehicle-side closing assembly, a locking device serving as a mass locking device, which is attached to the handle mounting and is designed such that, when subjected to the effects of an acceleration force, it can block an actuation of the closing assembly by means of the operating handle and/or by means of the coupling device, wherein the locking device has a locking element, which is moveably coupled to the mechanical coupling device by means of a connecting element such that the locking element can rotate about a rotational axis by means of a pivotal movement of the mechanical coupling device, wherein the locking element has at least one locking member attached to it, which is designed to block the rotational movement of the locking element when a predetermined displacement speed for the operating handle has been exceeded;

wherein the at least one locking member is designed in the manner of a lever and is supported at one of its two ends, radially offset to the rotational axis of the locking element at a point of rotation moving together with the locking element, such that it can rotate between a normal operating position, releasing a rotational movement of the locking element, and a blocking position, blocking a rotational movement of the locking element;

wherein an elastic spring element exerts a force pushing the at least one locking member into the normal operating position, wherein the at least one locking member is designed such that it can move, radially away from the rotational axis and to a blocking contour, against the force of the elastic spring element when the predetermined displacement speed for the operating handle has been exceeded, into its blocking position; and wherein a spring-type return element exerts a return force pushing the locking element back to a starting position, in which the operating handle is not displaced, wherein the return force of the return element is greater than the force of the elastic spring element.

2. The door handle assembly according to claim 1, wherein a first longitudinal end of the connecting element engages with the rotational axis of the locking element, and the other, second longitudinal end of the connecting element is attached to the mechanical coupling device at a spacing to its pivotal axis.

3. The door handle assembly according to claim 1, wherein the elastic spring element is a leg spring supported on the locking element and on the locking member, which exerts a force pushing the at least one locking member into the normal operating position, and which is disposed offset to the point of rotation of the locking member.

4. The door handle assembly according to claim 1, wherein the locking device has a housing shell attached to the handle mounting, in which the locking element is rotationally supported, wherein the blocking contour is designed as at least one convexity protruding radially outward and disposed outside of the movement path of the locking element on the encasing wall of the housing shell.

5. The door handle assembly according to claim 4, wherein the locking element is designed in the manner of a lever, having two locking members lying radially opposite one another.

6. The door handle assembly according to claim 1, wherein a return contour is provided, which guides the at least one locking member out of the blocking position into the normal operating position when the locking element is returned to its starting position.

7. The door handle assembly according to claim 1, wherein a Bowden cable device that actuates the vehicle-side closing assembly is functionally connected to either the locking element or the mechanical coupling device.

8. The door handle assembly according to claim 1, wherein the predetermined displacement speed of the operating handle is at least 2 m/sec.

9. The door handle assembly according to claim 1, wherein the rotational axis is substantially aligned transverse to the pivotal axis of the mechanical coupling device.

* * * * *